US008739569B2

(12) United States Patent
Oka et al.

(10) Patent No.: US 8,739,569 B2
(45) Date of Patent: Jun. 3, 2014

(54) LIQUEFIED GAS RELIQUEFIER, LIQUEFIED-GAS STORAGE FACILITY AND LIQUEFIED-GAS TRANSPORT SHIP INCLUDING THE SAME, AND LIQUEFIED-GAS RELIQUEFACTION METHOD

(75) Inventors: Masaru Oka, Nagasaki (JP); Sai Hiramatsu, Nagasaki (JP); Hitoshi Kondo, Kariya (JP); Yoshimasa Ohashi, Kariya (JP); Shigeo Nagaya, Nagoya (JP); Tsutomu Tamada, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 319 days.

(21) Appl. No.: 12/670,693

(22) PCT Filed: Feb. 26, 2009

(86) PCT No.: PCT/JP2009/053594

§ 371 (c)(1),
(2), (4) Date: Feb. 26, 2010

(87) PCT Pub. No.: WO2009/107743

PCT Pub. Date: Sep. 3, 2009

(65) Prior Publication Data

US 2010/0170297 A1 Jul. 8, 2010

(30) Foreign Application Priority Data

Feb. 27, 2008 (JP) ..... 2008-046910

(51) Int. Cl.
*F25J 1/00* (2006.01)
*F17C 13/08* (2006.01)

(52) U.S. Cl.
USPC ..... 62/614; 62/53.2

(58) Field of Classification Search
USPC ..... 62/611, 614, 45.1, 47.1, 48.2
See application file for complete search history.

(56) References Cited

U.S. PATENT DOCUMENTS 2,928,254 A * 3/1960 Randolph ..... 62/48.2
2,978,876 A * 4/1961 Pastuhov ..... 62/48.2

(Continued)

FOREIGN PATENT DOCUMENTS

DE 100 60 102 6/2001
JP 2001-304497 10/2001

(Continued)

OTHER PUBLICATIONS

International Search Report issued May 19, 2009 in International (PCT) Application No. PCT/JP2009/053594.

(Continued)

*Primary Examiner* — Frantz Jules
*Assistant Examiner* — Webeshet Mengesha
(74) *Attorney, Agent, or Firm* — Wenderoth, Lind & Ponack, L.L.P.

(57) ABSTRACT

A liquefied gas reliquefier reliquefies boil-off gas resulting from evaporation of liquefied gas in a liquefied-gas storage tank to prevent a rise in the internal pressure of the liquefied-gas storage tank. The liquefied gas reliquefier includes a cooling unit for liquefying a secondary refrigerant, a liquefied-secondary-refrigerant feeding unit for feeding the liquefied secondary refrigerant, and a heat exchange unit disposed in the secondary-refrigerant circulating channel to condense the BOG by heat exchange between the BOG and the liquefied secondary refrigerant. The heat exchange unit is disposed near the liquefied-gas storage tank. The cooling unit includes a plurality of pulse-tube refrigerators. The number of pulse-tube refrigerators in operation and/or the cooling capacities of the individual pulse-tube refrigerators are controlled based on a measurement result from at least one of a thermometer, a pressure gauge, and a pump discharge flow meter installed in the liquefied-gas storage tank.

17 Claims, 3 Drawing Sheets

(56) References Cited

U.S. PATENT DOCUMENTS

| | | | | |
|---|---|---|---|---|
| 3,768,271 | A * | 10/1973 | Denis | 62/50.3 |
| 5,415,196 | A | 5/1995 | Bryant et al. | |
| 2001/0018833 | A1* | 9/2001 | Pozivil | 62/613 |
| 2001/0042377 | A1 | 11/2001 | Pozivil | |
| 2006/0130519 | A1* | 6/2006 | Little | 62/612 |
| 2006/0156758 | A1 | 7/2006 | An et al. | |
| 2008/0120993 | A1 | 5/2008 | An et al. | |
| 2009/0113929 | A1* | 5/2009 | Haukedal | 62/612 |
| 2010/0139316 | A1* | 6/2010 | An et al. | 62/613 |

FOREIGN PATENT DOCUMENTS

| | | |
|---|---|---|
| JP | 2005-265170 | 9/2005 |
| JP | 2006-200735 | 8/2006 |
| KR | 10-2005-0094798 | 9/2005 |
| KR | 10-0699163 | 3/2007 |
| WO | 2006/078104 | 7/2006 |

OTHER PUBLICATIONS

Korean Office Action issued Oct. 6, 2011 in corresponding Korean Patent Application No. 10-2010-7002140 w/English translation.

Decision to Grant a Patent issued Nov. 6, 2012 in corresponding Japanese Patent Application No. 2008-046910.

* cited by examiner

LIQUEFIED GAS RELIQUEFIER, LIQUEFIED-GAS STORAGE FACILITY AND LIQUEFIED-GAS TRANSPORT SHIP INCLUDING THE SAME, AND LIQUEFIED-GAS RELIQUEFACTION METHOD

TECHNICAL FIELD

The present invention relates to liquefied gas reliquefiers for reliquefying boil-off gas (hereinafter abbreviated to "BOG") resulting from evaporation of liquefied gas such as LNG, to liquefied-gas storage facilities and liquefied-gas transport ships including such liquefied gas reliquefiers, and to liquefied-gas reliquefaction methods.

BACKGROUND ART

For example, LNG ships are equipped with LNG storage tanks (liquefied-gas storage tanks) storing LNG (liquefied natural gas). In the LNG storage tanks, incoming heat penetrating tank insulation evaporates the LNG to generate BOG. To keep the internal pressure of the LNG storage tanks constant while preventing a rise in the internal pressure due to the BOG, either a method of releasing the BOG to the outside air or a method of reliquefy the BOG and returning it to the LNG storage tanks is available. Typically used as the method of reliquefy the BOG and returning it to the LNG storage tanks is a method in which BOG taken out from the LNG storage tanks is pressurized by a compressor and is condensed by cooling with cold energy generated by a refrigerator (see PTL 1). A refrigerator used for such applications uses a Brayton cycle using, for example, nitrogen as a primary refrigerant.

CITATION LIST

Patent Literature

{PTL 1}
Japanese Unexamined Patent Application, Publication No. 2005-265170

SUMMARY OF INVENTION

A conventional cooling system using a Brayton cycle, however, has a problem in that it requires a large plant to be constructed, including a compressor and an expander, and that a certain level of skill is needed for handling.

An object of the present invention, which has been made in light of such circumstances, is to provide a liquefied gas reliquefier that can be configured in a simple manner and that is easy to handle, a liquefied-gas storage facility and liquefied-gas transport ship including such a liquefied gas reliquefier, and a liquefied-gas reliquefaction method.

To solve the above problem, a liquefied gas reliquefier, a liquefied-gas storage facility and liquefied-gas transport ship including the liquefied gas reliquefier, and a liquefied-gas reliquefaction method according to the present invention employ the following solutions.

A liquefied gas reliquefier according to the present invention is a liquefied gas reliquefier for reliquefying BOG resulting from evaporation of liquefied gas in a liquefied-gas storage tank. The liquefied gas reliquefier includes cooling unit disposed in a secondary-refrigerant circulating channel through which a secondary refrigerant that is a liquid having a melting point lower than a condensation temperature of the BOG circulates to liquefy the secondary refrigerant; liquefied-secondary-refrigerant feeding unit for feeding the liquefied secondary refrigerant cooled by the cooling unit through the secondary-refrigerant circulating channel; and heat exchange unit disposed in the secondary-refrigerant circulating channel to condense the BOG by heat exchange between the BOG and the liquefied secondary refrigerant fed by the liquefied-secondary-refrigerant feeding unit, and the heat exchange unit is disposed near the liquefied-gas storage tank.

The BOG resulting from evaporation of the liquefied gas in the liquefied-gas storage tank is condensed and reliquefied in the heat exchange unit by the liquefied secondary refrigerant liquefied by the cooling unit. The liquefied secondary refrigerant is fed to the heat exchange unit by the liquefied-secondary-refrigerant feeding unit. The secondary refrigerant circulates between the heat exchange unit and the cooling unit through the secondary-refrigerant circulating channel.

In the liquefied gas reliquefier of the present invention, because the heat exchange unit is disposed near the liquefied-gas storage tank, the BOG can be reliquefied near the liquefied-gas storage tank, so that systems such as piping for guiding the BOG to a cooling unit installed at a remote site distant from the liquefied-gas storage tank can be eliminated as much as possible. This avoids a rise in the temperature of the BOG due to incoming heat during transportation to the cooling unit, thus reducing the cooling power for reliquefying the BOG. In addition, because the reliquefaction is performed near the liquefied-gas storage tank, it is possible to simplify a system such as piping for returning the reliquefied liquefied gas into the liquefied-gas storage tank.

Because the secondary refrigerant liquefied by the cooling unit only needs to be fed to the heat exchange unit by the liquefied-secondary-refrigerant feeding unit and to be circulated through the secondary-refrigerant circulating channel, a configuration for feeding the secondary refrigerant to the heat exchange unit can be realized in a simple manner.

Because the cooling unit can be separated from the heat exchange unit by the secondary-refrigerant circulating channel and can be disposed remote from the liquefied-gas storage tank, the cooling unit can be disposed outside a hazardous gas area so that the cooling unit is easier to handle.

Cold-energy obtaining systems using cooling unit mainly include a forced circulation system in which a liquefied secondary refrigerant is supercooled (in the present description, the term "supercooled" means that the refrigerant is cooled to a liquid state at or below the boiling point thereof) and a natural circulation condensation system in which a gas secondary refrigerant is cooled and condensed.

Here the "liquefied gas" is typified by liquefied natural gas (LNG). The "secondary refrigerant" may be any refrigerant having a lower melting point than BOG, and an inert gas such as nitrogen or a hydrocarbon gas such as propane can be used for liquefied natural gas.

The "heat exchange unit" used is preferably a heat exchanger, and may otherwise be a pipe, through which the secondary refrigerant flows, wound around the liquefied-gas storage tank or a pipe or fitting associated with the tank.

In the liquefied gas reliquefier of the present invention, the heat exchange unit may be disposed above the liquefied-gas storage tank.

Because the heat exchange unit is disposed above the liquefied-gas storage tank, the liquefied gas condensed and reliquefied by the heat exchange unit can be returned into the liquefied-gas storage tank therebelow by means of gravity. This allows elimination of equipment such as a pump for pumping the reliquefied liquefied gas into the liquefied-gas storage tank.

In the liquefied gas reliquefier of the present invention, the heat exchange unit may be disposed in a header pipe disposed above a plurality of the liquefied-gas storage tanks.

The header pipe, into which the BOG is guided so that its flows join together, is disposed above the plurality of liquefied-gas storage tanks. The heat exchange unit can be disposed in the header pipe to realize reliquefaction by a simple configuration.

A header bypass pipe bypassing the header pipe may be provided, and the heat exchange unit may be disposed in the header bypass pipe.

In the liquefied gas reliquefier of the present invention, precooling unit for precooling the secondary refrigerant supplied into the secondary-refrigerant circulating channel with the boil-off gas may be provided.

A route for supplying the secondary refrigerant to the secondary-refrigerant circulating channel is provided, and the secondary refrigerant to be supplied can be precooled by cold energy possessed by the BOG to reduce the power for cooling and liquefying the secondary refrigerant.

In the liquefied gas reliquefier of the present invention, the flow rate of the liquefied secondary refrigerant fed by the liquefied-secondary-refrigerant feeding unit may be variable.

If the flow rate of the liquefied secondary refrigerant can be changed by the liquefied-secondary-refrigerant feeding unit, the liquefied secondary refrigerant can be prevented from solidifying due to supercooling.

In the liquefied gas reliquefier of the present invention, the cooling unit may include a plurality of pulse-tube refrigerators.

A pulse-tube refrigerator is smaller and therefore much easier to handle than a conventional Brayton-cycle refrigeration system. A plurality of pulse-tube refrigerators can be used in combination to achieve high redundancy and to ensure flexibility in maintenance as a refrigeration system. It is also possible to realize a refrigeration system that is less dependent on the level of skill of the operator than a conventional Brayton-cycle refrigeration system.

In the liquefied gas reliquefier of the present invention, the number of pulse-tube refrigerators in operation and/or the cooling capacities of the individual pulse-tube refrigerators are preferably controlled based on a measurement result from at least one of a thermometer, a pressure gauge, and a pump discharge flow meter installed in the liquefied-gas storage tank.

It is preferable that the composition and/or pressure of the secondary refrigerant can be set so that the BOG is condensed by evaporation of the secondary refrigerant. This significantly reduces the amount of secondary refrigerant circulated to the heat exchange unit.

A liquefied-gas storage facility of the present invention includes a liquefied-gas storage tank and one of the above liquefied gas reliquefiers for reliquefying BOG resulting from evaporation of liquefied gas in the liquefied-gas storage tank.

The liquefied gas reliquefier described above is suitable for use in a liquefied-gas storage facility. An example of a liquefied-gas storage facility is an offshore LNG storage facility for storing LNG in the ocean.

A liquefied-gas transport ship of the present invention includes a liquefied-gas storage tank and one of the above liquefied gas reliquefiers for reliquefying BOG resulting from evaporation of liquefied gas in the liquefied-gas storage tank.

The liquefied gas reliquefier described above is suitable for use in a liquefied-gas transport ship. An example of a liquefied-gas transport ship is an LNG ship for transporting LNG.

A liquefied-gas reliquefaction method of the present invention is a liquefied-gas reliquefaction method for reliquefying BOG resulting from evaporation of liquefied gas in a liquefied-gas storage tank. The liquefied-gas reliquefaction method includes cooling unit disposed in a secondary-refrigerant circulating channel through which a secondary refrigerant that is a liquid having a melting point lower than a condensation temperature of the BOG circulates to liquefy the secondary refrigerant; liquefied-secondary-refrigerant feeding unit for feeding the liquefied secondary refrigerant cooled by the cooling unit through the secondary-refrigerant circulating channel; and heat exchange unit disposed in the secondary-refrigerant circulating channel to condense the boil-off gas by heat exchange between the BOG and the liquefied secondary refrigerant fed by the liquefied-secondary-refrigerant feeding unit, and the heat exchange is performed near the liquefied-gas storage tank by the heat exchange unit.

According to the present invention, because the heat exchange unit for reliquefying the BOG with the secondary refrigerant is disposed near the liquefied-gas storage tank, the liquefied gas reliquefier can be realized with a simple configuration.

In addition, because the cooling unit is composed of the plurality of pulse-tube refrigerators, it is possible to achieve high redundancy as a refrigeration system and to realize a refrigeration system that does not depend on the level of skill of the operator.

DESCRIPTION OF EMBODIMENTS

Embodiments of the present invention will be described below with reference to the drawings.

First Embodiment

A first embodiment of the present invention will be described below using FIG. 1.

Figure 1:
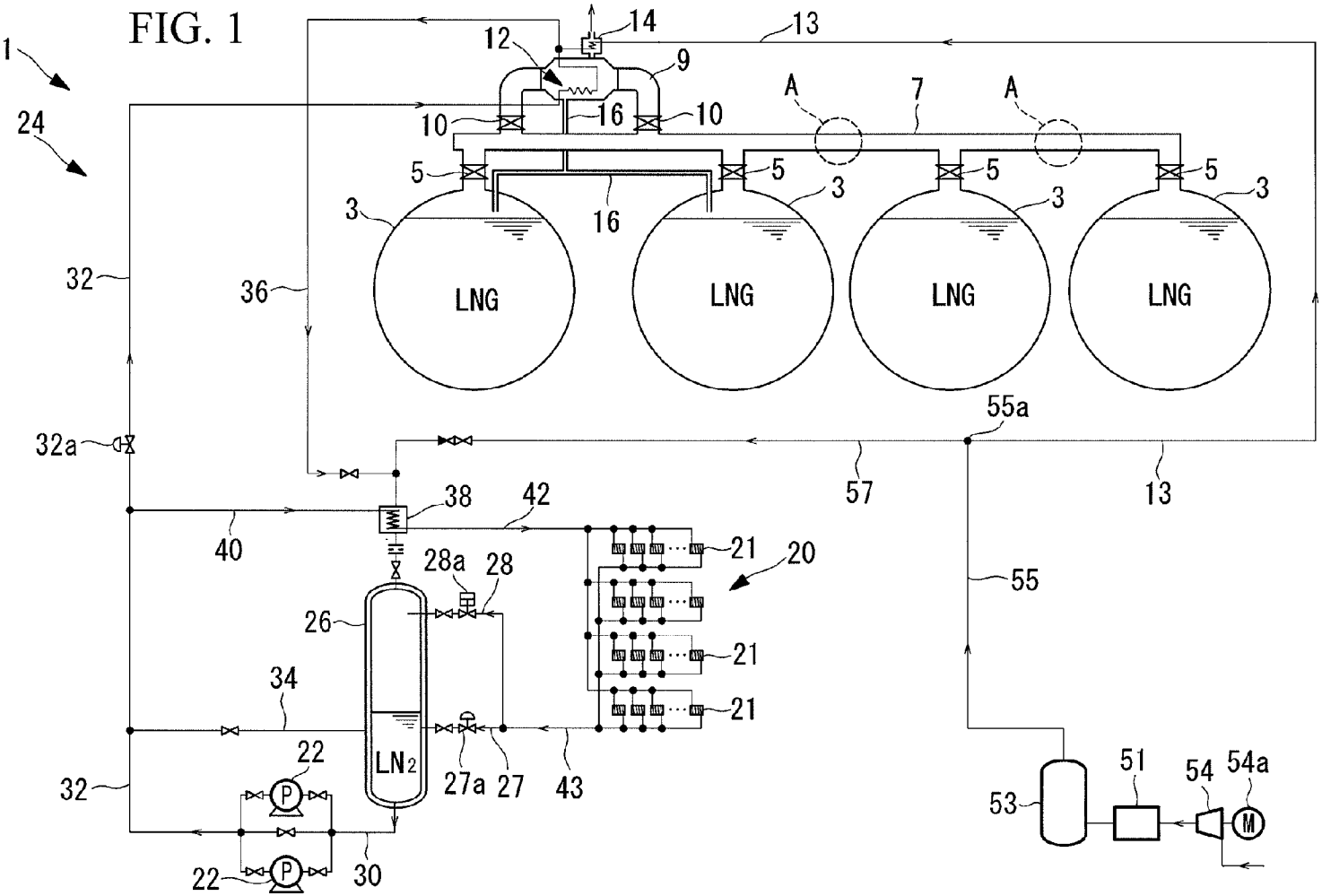
FIG. 1 is a schematic configuration diagram showing a relevant part of an LNG ship including a gas reliquefier according to a first embodiment of the present invention.

FIG. 1 shows a relevant part of an LNG ship (liquefied-gas transport ship) including a gas reliquefier 1.

The LNG ship includes a plurality of independent spherical cargo tanks (liquefied-gas storage tanks) 3, and each cargo tank 3 stores liquefied natural gas (LNG).

A vapor header line (header pipe) 7 is provided above the individual cargo tanks 3 with gate valves 5 therebetween. The vapor header line 7 is a common pipe connected to the individual cargo tanks 3 to recover BOG resulting from evaporation of the LNG in the individual cargo tanks 3 (hereinafter referred to as "BOG"). The vapor header line 7 has a bypass line (header bypass pipe) 9 extending from the vapor header line 7 in parallel therewith. Gate valves 10 are provided at both ends of the bypass line 9.

A heat exchanger 12 is accommodated in the channel of the bypass line 9, and the BOG resulting from evaporation in the individual cargo tanks 3 is condensed and reliquefied by the heat exchanger 12.

The bypass line 9 has a precooling heat exchanger 14 to which some of the BOG is supplied to precool nitrogen gas by means of cold energy possessed by the BOG. The nitrogen gas is compressed by a compressor 54, described later, and is then supplied to the precooling heat exchanger 14 via a first nitrogen-gas supply pipe 13.

An LNG return pipe 16 for returning the LNG reliquefied by the heat exchanger 12 to the individual cargo tanks 3 is provided on the bottom of the bypass line 9. In FIG. 1, the LNG return pipe 16 is connected only to the two cargo tanks 3 to the left in the figure; it is simplified merely to avoid complexity of illustration, and the LNG return pipe 16 is also connected to the two cargo tanks 3 to the right in the figure.

Figure 2A:
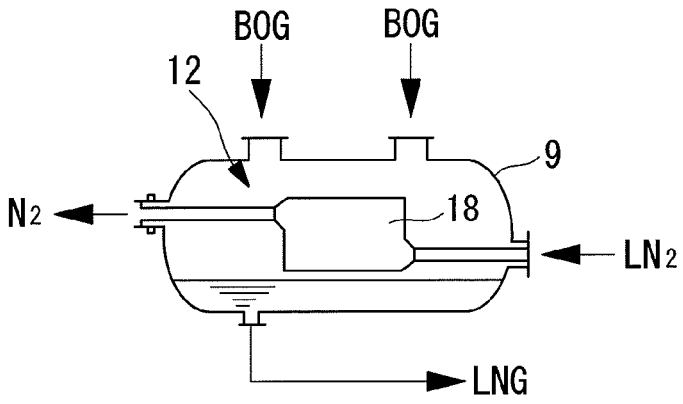
FIG. 2A is a schematic sectional view showing the details of a heat exchanger in FIG. 1.

As shown in FIG. 2A, Core-In-Kettle (registered trade mark) of Chart Energy & Chemicals, Inc., U.S., is suitable as the heat exchanger 12. Specifically, the configuration is such that a core 18 into which liquid nitrogen ($LN_2$) is guided is disposed in the bypass line 9. The core 18 is a plate-fin heat exchanger. The liquid nitrogen guided into the core 18 evaporates through heat exchange with the surrounding BOG and flows out from the core 18 as nitrogen gas ($N_2$).

As shown in FIG. 2A, the LNG cooled and condensed by the heat exchanger 12 is taken out from the bottom and is guided into the individual cargo tanks 3 through the LNG return pipe 16 shown in FIG. 1.

Figure 2B:
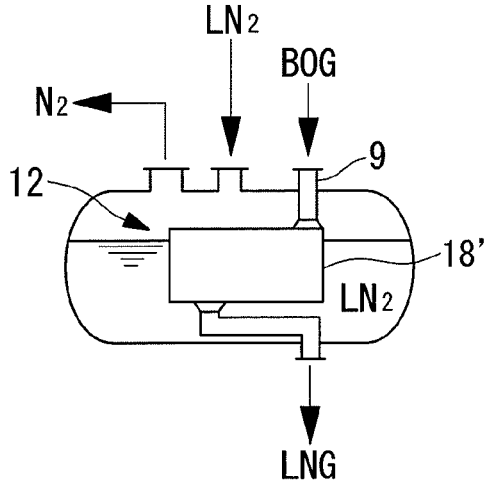
FIG. 2B is a schematic sectional view showing the details of the heat exchanger in FIG. 1.

In the configuration in FIG. 2A, the BOG is supplied from two positions on the top, and the BOG channel differs from that shown in FIG. 1; it is shown merely for ease of understanding, and the supply form is not limited as long as the configuration is such that the BOG is guided to the heat exchanger 12. For example, as shown in FIG. 2B, a core 18' may be provided at a certain position in the bypass line 9 such that the core 18' is immersed in $LN_2$.

The gas reliquefier 1 mainly includes the heat exchanger 12 described above, a refrigerator group (cooling unit) 20 for supercooling liquid nitrogen, feed pumps (liquefied-secondary-refrigerant feeding unit) 22 for feeding liquid nitrogen, and a circulating channel (secondary-refrigerant circulating channel) 24 for circulating nitrogen, serving as a secondary refrigerant, between the heat exchanger 12 and the refrigerator group 20.

The refrigerator group 20 includes a plurality of pulse-tube refrigerators 21. The pulse-tube refrigerators 21 form a pressure wave in a pulse tube filled with helium or the like by, for example, a compressor using a linear motor to form a phase shift between pressure variation and material variation through, for example, an orifice connected to the pulse tube, thereby providing cold energy. These pulse-tube refrigerators 21 have an advantage in that they have a low-vibration configuration requiring no sliding part in the cold-energy generating section. As shown in FIG. 1, the many pulse-tube refrigerators 21 are connected in parallel and in series with the liquid nitrogen channel so as to supercool liquid nitrogen. The plurality of pulse-tube refrigerators 21 can thus be connected to realize a configuration capable of flexibly supporting the necessary refrigeration capacity and having superior ease of maintenance.

The feed pumps 22 feed the liquid nitrogen cooled by the refrigerator group 20 to the heat exchanger 12 for circulation; in this embodiment, two feed pumps 22 are provided in parallel. The rotational speed of each feed pump 22 is variable so that the discharge flow rate can be freely changed. The discharge flow rate can thus be freely changed to prevent the supercooled liquid nitrogen from remaining and solidifying in the piping.

A vapor-liquid separation tank 26 is provided between the feed pumps 22 and the refrigerator group 20. A refrigerator-exit-side lower pipe 27 is connected to the lower portion of the vapor-liquid separation tank 26 to supply the liquid nitrogen from the refrigerator group 20 to the lower portion of the tank 27. In addition, a refrigerator-exit-side upper pipe 28 is connected to the upper portion of the vapor-liquid separation tank 26 to spray the liquid nitrogen supplied from the refrigerator group 20 into a vapor phase formed in the upper portion of the tank 26. The liquid nitrogen is thus sprayed into the vapor phase to effectively condense the nitrogen gas supplied into the tank 26.

The refrigerator-exit-side lower pipe 27 has a pressure control valve 27*a* so that the pressure of the liquid phase in the vapor-liquid separation tank 26 can be controlled. In addition, the refrigerator-exit-side upper pipe 28 has a pressure-reducing valve 28*a* so that the flow rate of the liquid nitrogen supplied into the vapor-liquid separation tank 26 can be controlled.

A liquid-nitrogen draining pipe 30 connected upstream of the feed pumps 22 is provided at the bottom end of the vapor-liquid separation tank 26. The liquid nitrogen is taken out through the liquid-nitrogen draining pipe 30 and is fed by the feed pumps 22.

A liquid-nitrogen discharging pipe 32 is provided downstream of the feed pumps 22. The liquid-nitrogen discharging pipe 32 is provided so as to extend between the feed pumps 22 and the heat exchanger 12. The liquid-nitrogen discharging pipe 32 has a pressure control valve 32*a* so that the pressure of the liquid nitrogen supplied to the heat exchanger 12 can be controlled.

A liquid-nitrogen bypass pipe 34 is provided between the lower portion of the vapor-liquid separation tank 26 and a certain position of the liquid-nitrogen discharging pipe 32. The liquid-nitrogen bypass pipe 34 allows some of the liquid nitrogen to return into the vapor-liquid separation tank 26.

A return-gas cooling heat exchanger 38 for precooling the nitrogen gas guided from the heat exchanger 12 through the nitrogen-gas return pipe 36 is provided above the vapor-liquid separation tank 26. The return-gas cooling heat exchanger 38 is connected to a liquid-nitrogen shunting pipe 40 extending from a certain position of the liquid-nitrogen discharging pipe 32 so that the supercooled liquid nitrogen is guided to the return-gas cooling heat exchanger 38. In addition, the liquid nitrogen flowing out from the return-gas cooling heat exchanger 38 is guided to the refrigerator group 20 via a refrigerator-group entrance pipe 42.

As above, the circulating channel 24 for the nitrogen serving as the secondary refrigerant is mainly composed of the feed pumps 22, the liquid-nitrogen discharging pipe 32, the heat exchanger 12, the nitrogen-gas return pipe 36, and the vapor-liquid separation tank 26.

The nitrogen used as the secondary refrigerant is supplied from a nitrogen gas generator (not shown). The nitrogen supplied from the nitrogen-gas generator is guided into the nitrogen-gas storage tank 53 after moisture and carbon dioxide are removed therefrom by a nitrogen gas dryer 51 (see the lower right of FIG. 1). The nitrogen-gas storage tank 53 is at room temperature.

The compressor 54, which is rotated by a motor 54*a*, is provided upstream of the nitrogen-gas storage tank 53. The compressor 54 used is preferably of the screw type. The nitrogen gas pressurized by the compressor 54 passes through a nitrogen-gas discharging pipe 55 and is guided into the first nitrogen-gas supply pipe 13 and a second nitrogen-gas supply pipe 57 at a node 55*a*.

The nitrogen gas guided via the first nitrogen-gas supply pipe 13 is precooled by the BOG in the precooling heat exchanger 14, as described above, and then joins the upstream side of the nitrogen-gas return pipe 36, which is located close to the heat exchanger 12.

The nitrogen gas guided via the second nitrogen-gas supply pipe 57 joins the downstream side of the gas return pipe 36, which is located close to the upstream side of the return-gas precooling heat exchanger 38.

Next, the operation of the LNG reliquefier 1 having the above configuration will be described.

The liquid nitrogen stored in the vapor-liquid separation tank 26 is taken out from the bottom end of the tank 26 via the liquid-nitrogen draining pipe 30 by the feed pumps 22 and is guided to the heat exchanger 12 via the liquid-nitrogen discharging pipe 32. The pressure of the liquid nitrogen guided to the heat exchanger 12 is adjusted by the pressure control valve 32*a*.

The liquid nitrogen guided to the heat exchanger 12 is subjected to heat exchange with the BOG guided into the bypass line 9. That is, in the heat exchanger 12, the liquid nitrogen applies the latent heat of evaporation to the BOG, thus evaporating. On the other hand, the BOG is cooled by the latent heat of evaporation of the liquid nitrogen, thus condensing. The condensed BOG is returned to the individual cargo tanks 3 via the LNG return pipe 16 as reliquefied LNG.

The nitrogen evaporated by the heat exchanger 12 is guided as nitrogen gas to the return-gas precooling heat exchanger 38 via the nitrogen-gas return pipe 36. In the return-gas precooling heat exchanger 38, the nitrogen gas is cooled by liquid nitrogen partially shunted from the liquid-nitrogen shunting pipe 40. The nitrogen gas cooled in the return-gas precooling heat exchanger 38 is guided into the vapor-liquid separation tank 26 from above the tank 26. The liquid nitrogen guided from the refrigerator-exit-side upper pipe 28 is sprayed into the upper space of the tank 26, namely, the vapor phase, so that the nitrogen gas supplied from thereabove condenses and accumulates in the lower space of the tank 26. The flow rate of the liquid nitrogen sprayed into the tank 26 can be adjusted by the pressure-reducing valve 28*a*.

The liquid nitrogen is cooled by the refrigerator group 20. That is, the liquid nitrogen guided via the refrigerator-group entrance pipe 42 is cooled to a supercooled state by the many pulse-tube refrigerators 21 connected in series and in parallel. The supercooled liquid nitrogen flows out via a refrigerator-group exit pipe 43, some of it being shunted to the refrigerator-exit-side upper pipe 28 and the rest flowing into the refrigerator-exit-side lower pipe 27. The liquid nitrogen is subjected to pressure adjustment by the pressure control valve 27*a* when passing through the refrigerator-exit-side lower pipe 27 and then flows into the vapor-liquid separation tank 26.

On the other hand, the nitrogen is supplied into the circulating channel 24 as follows.

The nitrogen guided from the nitrogen gas generator (not shown) is guided into the nitrogen-gas storage tank 53 after moisture and carbon dioxide are removed therefrom by the nitrogen gas dryer 51. Pressurized by the compressor 54 driven by the motor 54*a* and guided from the nitrogen-gas storage tank 53, the nitrogen gas is guided into the first nitrogen-gas supply pipe 13 and the second nitrogen-gas supply pipe 57 at the node 55*a*.

The nitrogen gas guided into the first nitrogen-gas supply pipe 13 is precooled by the sensible heat of the BOG in the precooling heat exchanger 14 and is guided into the nitrogen-gas return pipe 36. The BOG that has released cold energy through the precooling heat exchanger 14 is burned by burning means (not shown) and is released into the atmosphere. Some of the BOG is burned in this way to discharge nitrogen remaining and concentrating in the cargo tanks 3.

The nitrogen gas guided into the second nitrogen-gas supply pipe 57 joins the downstream side of the nitrogen-gas return pipe 36 and is then cooled by the return-gas precooling heat exchanger 38.

As above, the LNG reliquefier 1 according to this embodiment provides the following effects and advantages.

Because the heat exchanger 12 for condensing the BOG is disposed near the cargo tanks 3, the BOG generated in the cargo tanks 3 can be liquefied near the cargo tanks 3. Thus, systems such as piping for guiding the BOG to a cooling unit installed at a remote site distant from the cargo tanks 3 can be eliminated as much as possible. This avoids a rise in the temperature of the BOG due to incoming heat during transportation to the cooling unit, thus reducing the cooling power for liquefying the BOG. In addition, because the reliquefaction is performed near the cargo tanks 3, only the LNG return pipe 16 is needed to return the reliquefied LNG into the cargo tanks 3, thus eliminating a system such as redundant piping.

Because the secondary refrigerant (nitrogen) liquefied by the refrigerator group 20 only needs to be fed to the heat exchanger 12 by the feed pumps 22 and to be circulated through the secondary-refrigerant circulating channel 24, a configuration for feeding the secondary refrigerant (nitrogen) to the heat exchanger 12 can be realized in a simple manner.

Because the refrigerator group 20 can be separated from the heat exchanger 12 by the secondary-refrigerant circulating channel 24 and can be disposed remote from the cargo tanks 3, the refrigerator group 20 can be disposed outside a hazardous gas area so that the refrigerator group 20 is easier to handle.

Because the heat exchanger 12 is disposed above the cargo tanks 3, the LNG condensed and reliquefied by the heat exchanger 12 can be returned into the cargo tanks 3 therebelow by means of gravity. This allows elimination of equipment such as a pump for pumping the reliquefied LNG into the cargo tanks 3.

The bypass line 9 is disposed in parallel with the vapor header line 7 disposed above the LNG tanks, and the heat exchanger 12 is disposed in the bypass line 9. This allows the BOG to be reliquefied by a simple configuration.

Because the first nitrogen-gas supply pipe 13 for supplying nitrogen gas (secondary refrigerant) to the nitrogen-gas return pipe 36, which is a segment of the secondary-refrigerant circulating channel 24, is provided and the nitrogen gas to be supplied is precooled by cold energy possessed by the BOG in the precooling heat exchanger 14, the power for cooling and liquefying the nitrogen gas can be reduced.

In addition, because the room-temperature nitrogen gas guided from the second nitrogen-gas supply pipe 57 is precooled by the return-gas precooling heat exchanger 38, the cooling power for liquefying the nitrogen gas can be reduced.

Because the flow rate of the liquid nitrogen can be changed by the feed pumps 22, overly supercooled liquid nitrogen can be prevented from solidifying after remaining in the piping.

Because the refrigerator group 20 is composed of the plurality of pulse-tube refrigerators 21, which are smaller and much easier to handle than a conventional Brayton-cycle refrigeration system requiring a large compressor and expander, it is possible to achieve high redundancy and to ensure flexibility in maintenance to realize a system that does not depend on the level of skill of the operator.

Second Embodiment

Figure 3:
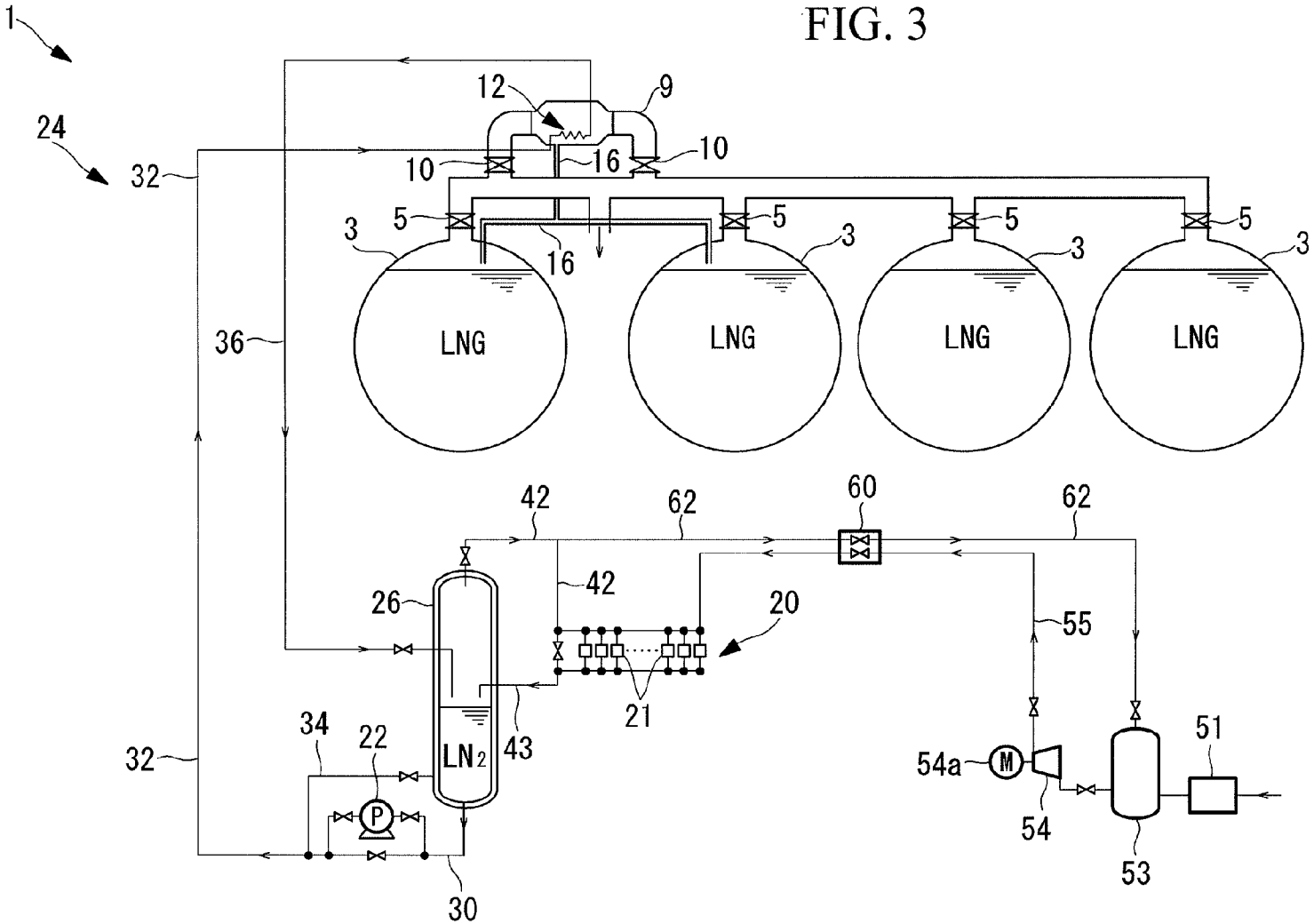
FIG. 3 is a schematic configuration diagram showing a relevant part of an LNG ship including a gas reliquefier according to a second embodiment of the present invention.

Next, a second embodiment of the present invention will be described using FIG. 3.

This embodiment differs primarily in that it employs a natural circulation condensation system in which nitrogen gas is cooled and condensed by the refrigerator group 20, rather than a forced circulation system in which liquid nitrogen is supercooled by the refrigerator group 20, as in the first embodiment. Accordingly, the same components as in the first embodiment are indicated by the same reference signs, and a description thereof will be omitted.

In this embodiment, the nitrogen-gas return pipe 36 for returning the nitrogen gas resulting from evaporation in the heat exchanger 12 is directly connected to the vapor-liquid separation tank 26. That is, the nitrogen gas returned from the nitrogen-gas return pipe 36 is supplied into the vapor phase in the vapor-liquid separation tank 26 without passing through a heat exchanger for precooling (see reference sign 38 in FIG. 1).

The refrigerator-group entrance pipe 42 is connected to the top end of the vapor-liquid separation tank 26, and the nitrogen gas is taken out from the vapor-liquid separation tank 26 at that position and is guided to the refrigerator group 20, when it is cooled and condensed. Although the plurality of pulse-tube refrigerators 21 constituting the refrigerator group 20 are connected only in parallel and not in series in FIG. 3, the present invention is not particularly limited to that configuration; the plurality of pulse-tube refrigerators 21 may be connected both in parallel and in series.

The liquid nitrogen cooled and condensed by the refrigerator group 20 is guided into the vapor-liquid separation tank 26 via the refrigerator-group exit pipe 43 and is stored in the tank 26.

On the other hand, the nitrogen gas compressed by the compressor 54 passes through the nitrogen-gas discharging pipe 55 via a gas-gas heat exchanger 60 and is then guided to the refrigerator group 20. The gas-gas heat exchanger 60 performs heat exchange between the room-temperature nitrogen gas flowing through the nitrogen-gas discharging pipe 55 and cooled nitrogen gas guided through a nitrogen-gas recovery pipe 62 extending from the refrigerator-group entrance pipe 42. The nitrogen gas supplied from the compressor 54 is precooled by the gas-gas heat exchanger 60 and is guided to the refrigerator group 20. This saves the cooling power for condensing the nitrogen gas.

Next, the operation of the LNG reliquefier 1 having the above configuration will be described.

The liquid nitrogen stored in the vapor-liquid separation tank 26 is taken out from the bottom end of the tank 26 via the liquid-nitrogen draining pipe 30 by the feed pumps 22 and is guided to the heat exchanger 12 via the liquid-nitrogen discharging pipe 32.

The liquid nitrogen guided to the heat exchanger 12 is subjected to heat exchange with the BOG guided into the bypass line 9. That is, in the heat exchanger 12, the liquid nitrogen applies the latent heat of evaporation to the BOG, thus evaporating. On the other hand, the BOG is cooled by the latent heat of evaporation of the liquid nitrogen, thus condensing. The condensed BOG is returned to the individual cargo tanks 3 via the LNG return pipe 16 as reliquefied LNG.

The nitrogen evaporated by the heat exchanger 12 is guided as nitrogen gas into the vapor phase in the vapor-liquid separation tank 26 via the nitrogen-gas return pipe 36. The nitrogen gas guided into the vapor-liquid separation tank 26 is guided to the refrigerator group 20 via the refrigerator-group entrance pipe 42 and is cooled and condensed by the individual pulse-tube refrigerators 21. Thus, this embodiment employs a natural circulation condensation system in which the nitrogen gas is condensed by the refrigerator group 20. The liquefied liquid nitrogen is guided into the vapor-liquid separation tank 26 via the refrigerator-group exit pipe 43 and is stored in the bottom of the tank 26.

Some of the nitrogen gas taken out from the vapor-liquid separation tank 26 via the refrigerator-group entrance pipe 42 is shunted without flowing to the refrigerator group 20 and is guided into the nitrogen-gas storage tank 53 via the nitrogen-gas recovery pipe 62. When passing through the nitrogen-gas recovery pipe 62, the nitrogen gas is subjected in the gas-gas heat exchanger 60 to heat exchange with the room-temperature nitrogen gas flowing through the nitrogen-gas discharging pipe 55 from the compressor 54 driven by the motor 54*a*. This causes the nitrogen gas fed from the compressor 54 to the refrigerator group 20 to be precooled, thus reducing the cooling power of the individual pulse-tube refrigerators 21.

As above, the LNG reliquefier 1 according to this embodiment provides the following effects and advantages.

Because the heat exchanger 12 for condensing the BOG is disposed near the cargo tanks 3, the BOG generated in the cargo tanks 3 can be liquefied near the cargo tanks 3. Thus, systems such as piping for guiding the BOG to a cooling unit installed at a remote site distant from the cargo tanks 3 can be eliminated as much as possible. This avoids a rise in the temperature of the BOG due to incoming heat during transportation to the cooling unit, thus reducing the cooling power for liquefying the BOG. In addition, because the reliquefaction is performed near the cargo tanks 3, only the LNG return pipe 16 is needed to return the reliquefied LNG into the cargo tanks 3, thus eliminating a system such as redundant piping.

Because the secondary refrigerant (nitrogen) liquefied by the refrigerator group 20 only needs to be fed to the heat exchanger 12 by the feed pumps 22 and to be circulated through the secondary-refrigerant circulating channel 24, the liquefied refrigerant is easy to handle as compared with the case where a primary refrigerant liquefied by a refrigerator is fed, as in the conventional art, and a configuration for feeding the secondary refrigerant to the heat exchanger 12 can be realized in a simple manner.

Because the refrigerator group 20 can be separated from the heat exchanger 12 by the secondary-refrigerant circulating channel 24 and can be disposed remote from the cargo tanks 3, the refrigerator group 20 can be disposed outside a hazardous gas area so that the refrigerator group 20 is easier to handle.

Because the heat exchanger 12 is disposed above the cargo tanks 3, the LNG condensed and reliquefied by the heat exchanger 12 can be returned into the cargo tanks 3 therebelow by means of gravity. This allows elimination of equipment such as a pump for pumping the reliquefied LNG into the cargo tanks 3.

The bypass line 9 is disposed in parallel with the vapor header line 7, into which the BOG is guided, disposed above the LNG tanks, and the heat exchanger 12 is disposed in the bypass line 9. This allows the BOG to be reliquefied by a simple configuration.

Because the nitrogen gas supplied from the compressor 54 to the refrigerator group 20 is cooled by the gas-gas heat exchanger 60, the cooling power of the pulse-tube refrigerators 21 constituting the refrigerator group 20 can be reduced.

Because the refrigerator group 20 is composed of the plurality of pulse-tube refrigerators 21, which are smaller and much easier to handle than a conventional Brayton-cycle refrigeration system requiring a large compressor and expander, it is possible to achieve high redundancy and to ensure flexibility in maintenance to realize a system that does not depend on the level of skill of the operator.

Although LNG reliquefiers used for LNG ships have been described in the above embodiments, the present invention is not limited thereto; it can also be applied to, for example, an LNG storage facility, particularly, an LNG storage facility installed in the ocean.

In addition, although a description has been given by taking LNG as an example of the gas to be reliquefied, the present invention is not limited thereto; it can also be applied to, for example, LPG or ammonia instead of LNG.

In addition, although a description has been given by taking nitrogen as an example of the secondary refrigerant, the present invention is not limited thereto; other gases, including inert gases such as argon, can be used instead of nitrogen.

In addition, although the heat exchanger 12 is disposed in the bypass line 9, the present invention is not limited thereto; for example, as indicated by reference sign A in FIG. 1, a plurality of heat exchangers 12 may be provided in the vapor header line 7 (preferably, one at each of the positions between the cargo tanks 3). This allows the bypass line 9 to be eliminated, thus further simplifying the configuration. As a matter of course, this configuration can also be applied to the second embodiment shown in FIG. 3.

In addition, although the configuration in which the heat exchanger 12 inserted into the bypass line 9 or the vapor header line 7 has been described as a specific example, other configurations are permitted as a matter of course. For example, pipes through which liquid nitrogen flows may be wound around the cargo tanks 3 or pipes or fittings associated with the cargo tanks 3.

In addition, it is preferable that the composition and/or pressure of the secondary refrigerant can be set so that the BOG is condensed by evaporation of the secondary refrigerant. This significantly reduces the amount of secondary refrigerant circulated to the heat exchange unit.

In addition, the number of pulse-tube refrigerators 21 in operation and/or the cooling capacities of the individual pulse-tube refrigerators 21 are preferably controlled based on measurement results from at least one of thermometers, pressure gauges, and pump discharge flow meters installed in the cargo tanks 3.

REFERENCE SIGNS LIST

1 LNG reliquefier (liquefied gas reliquefier)
3 cargo tank (liquefied-gas storage tank)
7 vapor header line (header pipe)
12 heat exchanger (heat exchange unit)
20 refrigerator group (cooling unit)
21 pulse-tube refrigerator
22 feed pump (liquefied-secondary-refrigerant feeding unit)
24 secondary-refrigerant circulating channel
26 vapor-liquid separation tank

The invention claimed is:

1. A liquefied gas reliquefier for reliquefying boil-off gas (hereinafter abbreviated to "BOG") resulting from evaporation of liquefied gas in a plurality of liquefied-gas storage tanks to prevent a rise in the internal pressure of the liquefied-gas storage tanks, the liquefied gas reliquefier comprising:

a cooling unit for liquefying a secondary refrigerant which is a liquid having a melting point lower than a condensation temperature of the BOG, the cooling unit being disposed in a secondary-refrigerant circulating channel through which the secondary refrigerant circulates;

a liquefied-secondary-refrigerant feeding unit for feeding the liquefied secondary refrigerant cooled by the cooling unit through the secondary-refrigerant circulating channel;

a heat exchange unit disposed in the secondary-refrigerant circulating channel to condense the BOG by heat exchange between the BOG and the liquefied secondary refrigerant fed by the liquefied-secondary-refrigerant feeding unit;

a header pipe for being disposed above the plurality of liquefied-gas storage tanks;

a precooling unit for precooling the secondary refrigerant supplied into the secondary-refrigerant circulating channel with cold energy possessed by the BOG, wherein the heat exchange unit is disposed inside a channel of the header pipe, wherein the cooling unit includes a plurality of pulse-tube refrigerators, and wherein the number of pulse-tube refrigerators in operation and/or the cooling capacities of the individual pulse-tube refrigerators are controlled based on a measurement result from at least one of thermometers, pressure gauges, and pump discharge flow meters installed in the liquefied gas storage tanks.

2. The liquefied gas reliquefier of claim 1, wherein the flow rate of the liquefied secondary refrigerant fed by the liquefied-secondary-refrigerant feeding unit is variable.

3. The liquefied gas reliquefier of claim 1, wherein the composition and/or pressure of the secondary refrigerant can be set so that the BOG is condensed by evaporation of the secondary refrigerant.

4. A liquefied-gas storage facility comprising:

a plurality of liquefied-gas storage tanks; and the liquefied gas reliquefier of claim 1 for reliquefying BOG resulting from evaporation of liquefied gas in the liquefied-gas storage tanks.

5. A liquefied-gas transport ship comprising:

a plurality of liquefied-gas storage tanks; and the liquefied gas reliquefier of claim 1 for reliquefying BOG resulting from evaporation of liquefied gas in the liquefied-gas storage tanks.

6. A liquefied-gas reliquefication method for reliquefying BOG resulting from evaporation of liquefied gas in a plurality of liquefied-gas storage tanks, the method comprising:

liquefying a secondary refrigerant using a cooling unit, the cooling unit being disposed in a secondary-refrigerant circulating channel through which the secondary refrigerant circulates, the secondary refrigerant having a melting point lower than a condensation temperature of the BOG, and the cooling unit including a plurality of pulse-tube refrigerators, feeding the liquefied secondary refrigerant cooled by the cooling unit through the secondary-refrigerant circulating channel using a liquefied-secondary-refrigerant feeding unit;

condensing the BOG by heat exchange between the BOG and the liquefied secondary refrigerant fed by the liquefied-secondary-refrigerant feeding unit using a heat exchange unit disposed in the secondary-refrigerant circulating channel;

controlling the number of pulse-tube refrigerators in operation and/or the cooling capacities of the individual pulse-tube refrigerators based on a measurement result from at least one of thermometers, pressure gauges, and pump discharge flow meters installed in the liquefied gas storage tanks; and precooling the secondary refrigerant supplied into the secondary-refrigerant circulating channel with cold energy possessed by the BOG using a precooling unit, wherein the heat exchange unit is disposed inside a channel of a header pipe disposed above the plurality of liquefied-gas storage tanks.

7. The method of claim 6, wherein said feeding the liquefied secondary refrigerant operation includes feeding the liquefied secondary refrigerant with a variable flow rate.

8. The method of claim 6, further comprising setting the composition and/or pressure of the secondary refrigerant such that the BOG is condensed by evaporation of the secondary refrigerant.

9. The method of claim 6, further comprising condensing the BOG by evaporation of the secondary refrigerant.

10. The method of claim 6, wherein the method is performed in a liquefied-gas storage facility including the liquefied-gas storage tanks.

11. The method of claim 6, wherein the method is performed in a liquefied-gas transport ship including the liquefied-gas storage tanks.

12. The method of claim 6, wherein the header pipe includes a bypass line, and the heat exchange unit is disposed in the bypass line, and wherein the method further comprises returning condensed BOG from the bypass line to the liquefied-gas storage tanks using an LNG return pipe which connects the bypass line of the header pipe to the liquefied-gas storage tanks.

13. The liquefied gas reliquefier of claim 1, wherein the header pipe includes a bypass line, and the heat exchange unit is disposed in the bypass line, and wherein an LNG return pipe is provided for connecting the bypass line of the header pipe to the liquefied-gas storage tanks, the LNG return pipe being configured to convey condensed BOG from the bypass line to the liquefied-gas storage tanks.

14. A liquefied-gas storage facility comprising:

a plurality of liquefied-gas storage tanks; and a liquefied gas reliquefier for reliquefying boil-off gas (hereinafter abbreviated to "BOG") resulting from evaporation of liquefied gas in the plurality of liquefied-gas storage tanks to prevent a rise in the internal pressure of the liquefied-gas storage tanks, the liquefied gas reliquefier comprising:

i. a cooling unit for liquefying a secondary refrigerant which is a liquid having a melting point lower than a condensation temperature of the BOG, the cooling unit being disposed in a secondary-refrigerant circulating channel through which the secondary refrigerant circulates;

ii. a liquefied-secondary-refrigerant feeding unit for feeding the liquefied secondary refrigerant cooled by the cooling unit through the secondary-refrigerant circulating channel;

iii. a heat exchange unit disposed in the secondary-refrigerant circulating channel to condense the BOG by heat exchange between the BOG and the liquefied secondary refrigerant fed by the liquefied-secondary-refrigerant feeding unit;

iv. a header pipe disposed above the plurality of liquefied-gas storage tanks;

v. a precooling unit for precooling the secondary refrigerant supplied into the secondary-refrigerant circulating channel with cold energy possessed by the BOG, wherein the header pipe defines a channel which connects the liquefied-gas storage tanks to each other, wherein the heat exchange unit is disposed inside the channel of the header pipe, wherein the cooling unit includes a plurality of pulse-tube refrigerators, and wherein the number of pulse-tube refrigerators in operation and/or the cooling capacities of the individual pulse-tube refrigerators are controlled based on a measurement result from at least one of thermometers, pressure gauges, and pump discharge flow meters installed in the liquefied gas storage tanks.

15. The liquefied-gas storage facility of claim 14, wherein the header pipe includes a bypass line, and the heat exchange unit is disposed in the bypass line, and wherein an LNG return pipe is provided which connects the bypass line of the header pipe to the liquefied-gas storage tanks, the LNG return pipe being configured to convey condensed BOG from the bypass line to the liquefied-gas storage tanks.

16. The liquefied-gas storage facility of claim 15, further comprising a gate valve arranged to control a flow of BOG into the bypass line.

17. The liquefied-gas storage facility of claim 15, wherein the precooling unit is connected to the bypass line.

* * * * *